US005534755A

United States Patent [19]

Deavenport et al.

[11] Patent Number: 5,534,755

[45] Date of Patent: Jul. 9, 1996

[54] SYSTEM FOR PROVIDING A CONSTANT CURRENT TO A FLUORESCENT TUBE

[75] Inventors: Joe E. Deavenport, San Diego, Calif.; Joel A. Naive, Bigfork, Mont.

[73] Assignee: Hughes Aircraft Company, Los Angeles, Calif.

[21] Appl. No.: 241,932

[22] Filed: May 11, 1994

Related U.S. Application Data

[63] Continuation of Ser. No. 569,941, Aug. 17, 1990, abandoned.

[51] Int. Cl.[6] ..... H05B 41/392

[52] U.S. Cl. ..... 315/307; 315/224; 315/287; 315/DIG. 5

[58] Field of Search ..... 315/307, 247, 315/291, 287, 224, 302, DIG. 7, 311, DIG. 5, 208

[56] References Cited

U.S. PATENT DOCUMENTS 3,999,100 12/1976 Dendy et al. ..... 315/287
4,777,409 10/1988 Tracy et al. ..... 315/224
4,870,327 9/1989 Jorgensen ..... 315/307
4,958,108 9/1990 Jorgensen ..... 315/307

FOREIGN PATENT DOCUMENTS 0653778 10/1976 U.S.S.R. ..... 315/307
2080641 2/1982 United Kingdom ..... 315/307

*Primary Examiner*—Georgia Y. Epps
*Assistant Examiner*—Tan Dinh
*Attorney, Agent, or Firm*—Leonard A. Alkov; W. K. Denson-Low

[57] ABSTRACT

A system for energizing a fluorescent lamp by a current having an adjustable level of magnitude that is independent of the voltage across the fluorescent tube, which current is non-pulsing with the polarity being periodically changed at the conventional, 60 Hz rate of the AC power line by an electronic commutator, which commutator provides switching of the polarities at very sharp rise times, allowing use of relatively small components with the low frequencies, and the power factor of the input current is processed to a desired power factor. The constant current magnitude is adjustable over a wide range, which current settings are independent of the AC power line voltage and independent of the voltage across the lamp.

5 Claims, 5 Drawing Sheets

SYSTEM FOR PROVIDING A CONSTANT CURRENT TO A FLUORESCENT TUBE

This is a continuation of application Ser. No. 07/569,941, filed Aug. 17, 1990 and now abandoned.

BACKGROUND OF THE INVENTION

Fluorescent lamps in the past have been energized by coil and core ballasts which supply energy to the lamps at the same low frequency alternating current (AC) as the power being supplied to the ballast. These conventional ballasts exhibit several major disadvantages: poor efficiency, wasting electrical energy in the form of heat, no adjustment of light output, poor regulation of light output with varying input voltage, possible audible hum, some light output flicker, and poor power factor load to the source of the AC power.

Modern electronic ballasts offer advantages over the conventional coil and core ballasts but still have certain limitations and in addition introduce at least one additional disadvantage. Existing electronic ballasts operate on essentially the same principle as coil and core ballasts except that the low frequency alternating, drive is converted to a high frequency drive. Regulation of drive to the lamps is limited in both cases, but not controlled. High frequency electronic ballasts offer good efficiency, eliminate audible hum, eliminate flicker, and may provide moderate input factor, however they do not offer improvement in light regulation with AC power line variations, offer no control of light output, and introduce significantly greater radio frequency emissions.

Accordingly it is desirable to have a new and improved circuit for providing power to the fluorescent lamp and substantially eliminating all of the prior problems.

SUMMARY OF THE INVENTION

The invention is based upon the realization by the inventors that the prior problems involved in exciting a fluorescent lamp to obtain luminance from the lamp can be eliminated or substantially reduced by driving the fluorescent lamp with a constant magnitude of current, the magnitude of which may be selectively set. This current magnitude is independent of the voltage across the lamp or voltage changes across the lamp. The polarity of this current is switched periodically, preferably at the frequency of the AC power line utilizing an electronic commutator. The polarity of the current is switched at a very high speed providing a very short duration time gap of no current, maintaining the constant level of magnitude of the current across the fluorescent lamp, even though the polarity is switched at the AC power line rate.

Conventional coil and core ballasts that operate at the AC power line frequency, provide power to the lamp for only a part of the time. They provide power to the lamp during the peaks of both the positive and negative cycles of the input waveform but do not provide power during a substantial portion of the crossover time. With a 60 Hz AC power line frequency the total cycle time is approximately 16 milliseconds, and the off time is approximately 8 milliseconds. This results in a reduced lamp efficiency of light output versus power input. In addition there is a resultant visual flicker of light.

The inventor's preferred embodiment switches the constant magnitude drive current to the lamps at the low frequency AC power line rate but does so with very fast switching so that the current off time is approximately 0.03% of the cycle time resulting in no loss in lamp efficiency because of off time and no flicker. Existing electronic ballasts also utilize fast switching times, however the frequency of the switching rate is very high which results in the generation of considerably more radio frequency energy than in the preferred embodiment.

The circuit of the inventors preferred embodiment further includes a power factor correcting circuit so that the current drawn from the AC power line is directly proportional to the voltage provided by the AC power line, which by definition means high, near unity power factor.

Included in the inventors preferred embodiment is a circuit for continuous adjustment of the constant current drive to the fluorescent lamp from an amplitude of the nominal output level down to some fraction thereof, say 10% to 20%.

Conventional coil and core ballasts and existing electronic ballasts utilize reactors to limit the current drive to the fluorescent lamp. They do not hold the lamp drive constant with variations in AC power line voltage, and they do not provide any adjustment of the level of current drive. The proposed embodiment controls the level of current drive to the fluorescent lamps with a control circuit utilizing feedback to maintain a constant drive. The control circuit utilizes a simple remote sensor for level control over a 5:1 to 10:1 range of current amplitude.

The remaining element included in the preferred embodiment is a circuit for initially igniting the fluorescent lamps. The gas in the fluorescent lamps requires a high voltage to ionize. The gas will remain ionized so long as current flow continues with an interruption of no more than 5 microseconds. The gas is still partially ionized with longer current interruptions, but requires an increased voltage for reignition. Ionization is enhanced by the use of filaments incorporated in some lamps.

It is therefore an object of this invention to provide a new and improved circuit for igniting, and energizing fluorescent lamps.

Other objects and many attended advantages of this invention will become more apparent upon a reading of the specification and an examination of the drawings, wherein like reference numerals designate like parts throughout and in which:

DETAILED DESCRIPTION OF THE PREFERRED EMBODIMENT

Figure 1:
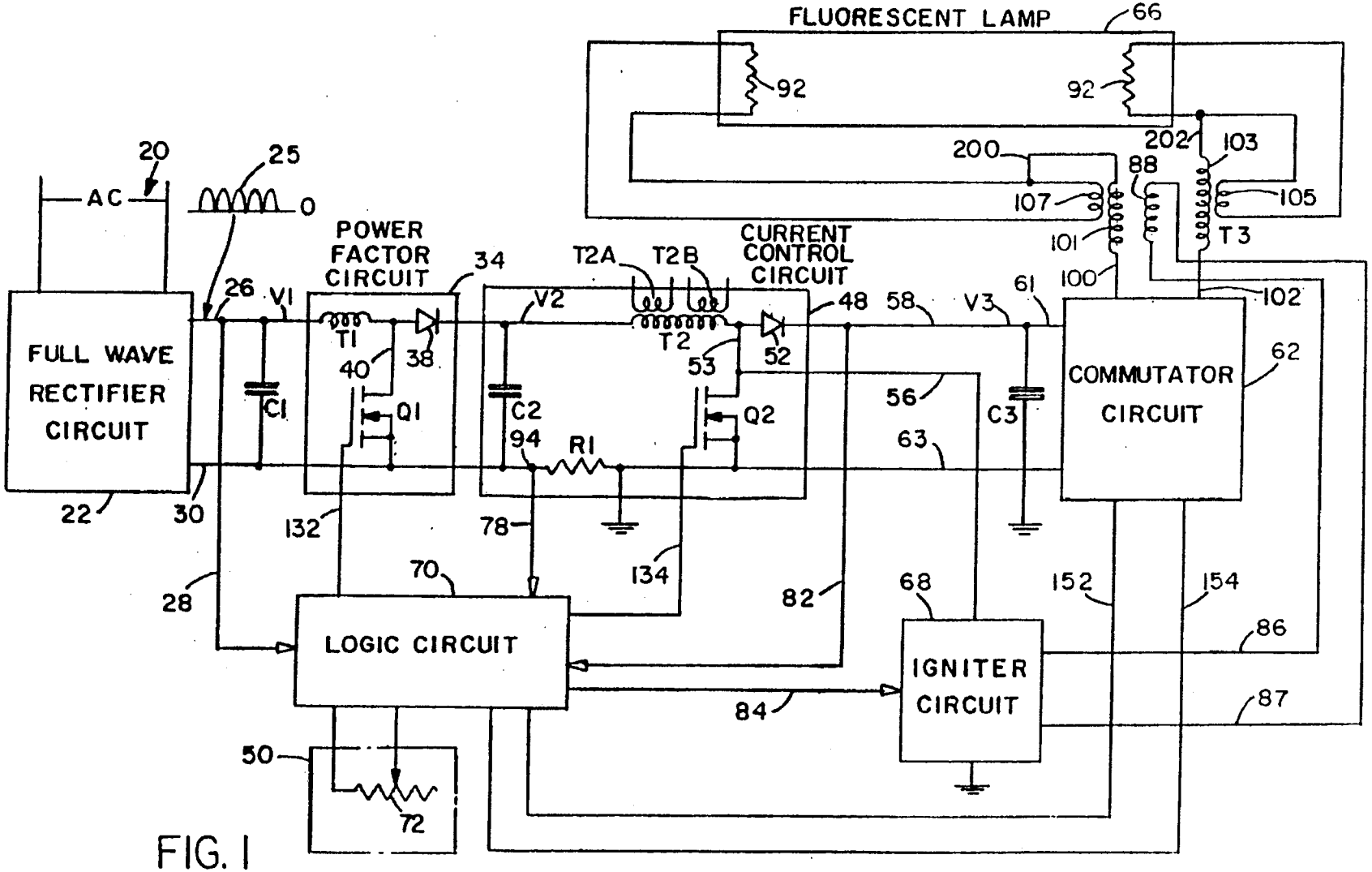
FIG. 1 is an overall block and schematic diagram of an embodiment of the invention.

Referring now to FIG. 1, a standard source of 60 cycle AC power 20 provides power for driving the fluorescent lamp. The 60 cycle power is fed to a full wave rectifier circuit 22, that provides full wave rectified direct current (DC) into capacitor C1 through lines 26 and 30 having a voltage V1 which varies at a 60 Hz rate as shown at 25. Capacitor C1 blocks the high frequency current in winding T1 created by opening and closing the FET transistor Q1, and prevents this high frequency current from flowing in the full wave rectifier circuit. The function and purpose of the AC power factor circuit is to provide a resistive impedance to the power source 20, wherein the voltage V1 and current in line 26 are proportional and in the same phase. Thus results in a power factor near one. The power factor circuit 34 draws current from its input 26 that is proportional to the input voltage V1, and has thus the input impedance of a resistor. The power factor circuit feeds its output current to a current storage capacitor C2, that is known as the "bulk" capacitor.

In this operation of the power factor circuit 34, the current passes through the inductor winding T1, and through unidirectional device 38 to the capacitor C2. An FET transistor Q1 functions as a high frequency switch to open and close line 40 across the input circuit. The FET transistors used are such that when a positive logic level is on the gate with respect to the source, then the source causes a current drain to a source to be a very low R-type that is under 0.1 ohm. Transistor Q1 is controlled by an input to its gate received from line 132 and the logic circuit 70. When transistor switch Q1 closes line 40 to line 30, then the input voltage V1 is across winding T1 and the current causes energy to be stored in winding T1. The amplitude of current flowing in winding T1 is directly proportional to the amplitude of volt V1. When transistor Q1 is opened in response to the control pulse in line 132, and causes the collapsing of the field across winding T1, this causes fly-back current to flow through to capacitor C2 through unidirectional device 38. Winding T1 is a relatively small winding, thus creating a low impedance to low frequency and a high impedance to high frequency. When transistor Q1 is open and dumps current from winding T1 into capacitor C2, capacitor C2 having a large current storage causes very little change in voltage V2, which is about 200 volts, representative. So capacitor C2 filters the current at this point and stores the current for operation of the fluorescent lamp.

Figures 2A, 2B:
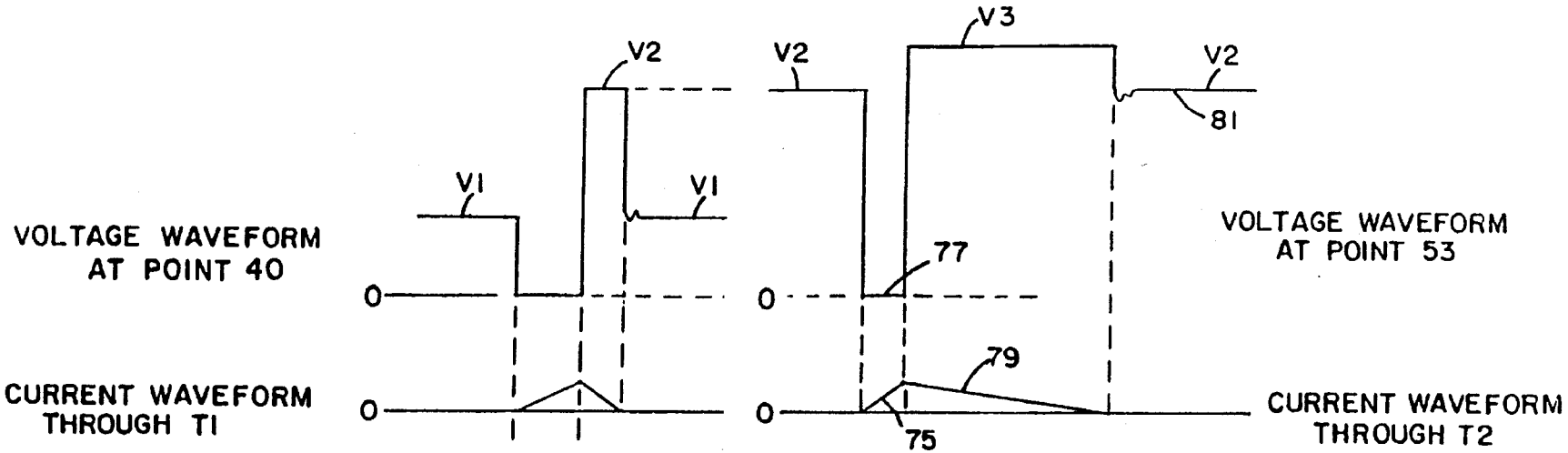
FIG. 2A is a diagrammatic illustration of the voltage levels at line 40 and the current in T1 in reference to the power factor circuit.
FIG. 2B is a diagram of the voltage levels at line 53 and the current through T2 in reference to the current control circuit.

The current control circuit 48 takes energy from the bulk capacitor C2, see FIG. 1, and converts this energy to a controlled current source for the commutator circuit 62. The current magnitude is controlled or set by a remote control sensor 72, see FIG. 5, as will be described in more detail hereinafter, and is held to that value by the action of the feedback sensing of the sense resistor R1. More specifically, current from capacitor C2 is fed through winding T2 and unidirectional device 52 through line 58 and to the capacitor C3. Winding T2 stores energy during the period of time that the field effect transistor Q2 is closed. This results in the current increase 75 and voltage decrease level 77 of FIG. 2B. When transistor Q2 is opened by a control signal through line 134 from logic circuit 70, then the fly-back stored current in winding T2 is fed through unidirectional device 52 and through line 58 to capacitor C3. Constant magnitude of current from capacitor C3 is fed through line 61 to the commutator circuit 62, that provides switched constant magnitude, current through lines 100 or 102 to the fluorescent lamp 66. This corresponds to the discharge current 79 in FIG. 2B, with the voltage at point 53 being held to the V3 voltage that is determined by the lamp 66. During the dead time when Q2 is open and the stored energy in T2 has been transferred to C3, the voltage 53 drops back to V2.

The logic circuit 70 provides controlled pulses in a manner that will be described in more detail hereinafter, to transistor Q1 through line 132 and to transistor Q2 through line 134, in a timing sequence that provides pulse width modulation of the input current to the commutator circuit. Transformer T2 has other windings T2A and T2B, that will be described in more detail hereinafter. The constant current supplied to the commutator circuit 62 is detected by resistor R1, the sense resistor, in coordination with the logic circuit 70. Thee double, pulse-width modulation by switches Q1 and Q2, sets the current magnitude in line 61. The bulk capacitor C2 assures constant current flowing in the circuit and lamp 66 during the low current times in the AC input power. This further allows 60 cycle operation that reduces RF interference.

The commutator circuit 62 receives constant current from the current control circuit 48 and capacitor C3, and has high speed switching means that alternately, and virtually instantly, reverses the polarity of the current to the lamp 66. The commutator circuit uses four electronic switches and no transformers, and thus small size components and low frequencies may be used. The current in line 61 has a constant magnitude. This current magnitude is constant irregardless of voltage changes. Further, this current is smooth to the point that there is relatively insignificant ripple. This current is switched by the commutator circuit 62 with high speed switching, which switches provide essentially a square wave with very fast rise times, that delivers the current with a controlled, constant magnitude across the lamp 66. Since the switches essentially switch the current on a 60 Hz timing, and since the operation of the commutator switches are at a rate of approximately 3 μsec, the current while being switched in polarity still has a constant current magnitude at all times across the lamp. The absolute magnitude of this constant current is set and controlled by the pulse width modulator in the logic circuit 70 which provides the timing of transistors Q1 and Q2. Resistor R1 senses the current that goes to the current commutator circuit. Thus, the current magnitude is controlled by the logic circuit in response to the current through sense resistor R1. If the logic circuit asks for a larger amount of current, then the current will increase until the feedback from the sense resistor R1 limits this current.

Figure 3:
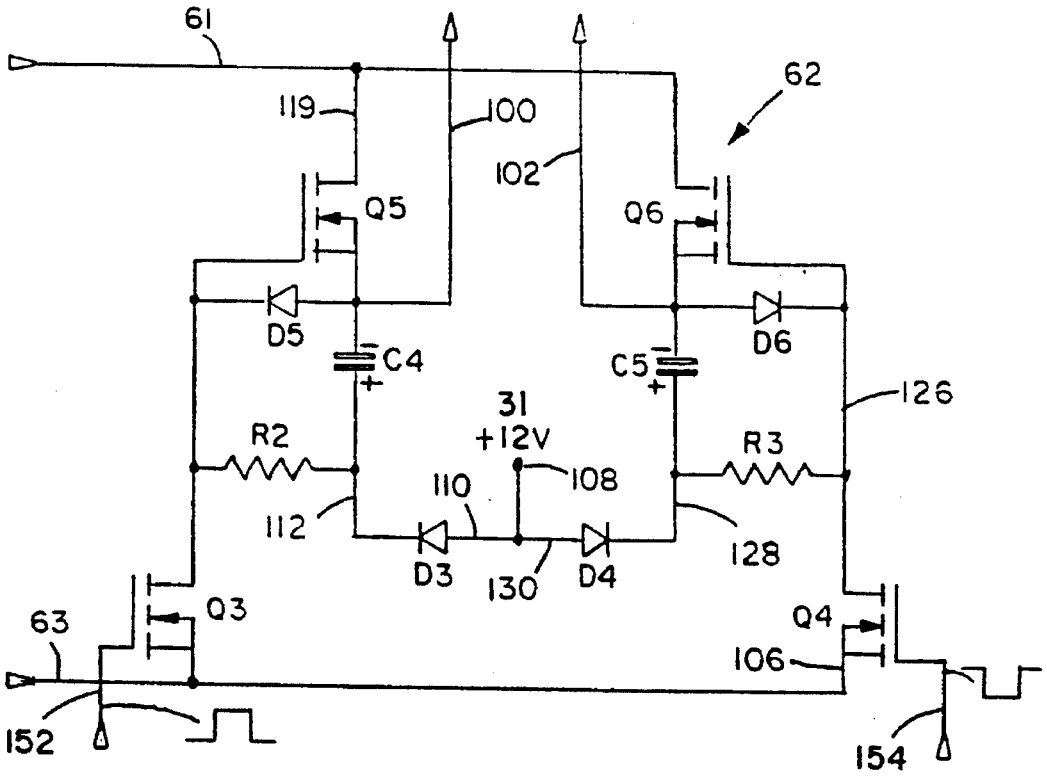
FIG. 3 is a schematic diagram of the commutator circuit that receives current from the control circuit and feeds this current to the fluorescent lamp.

Referring now to the commutator circuit in FIG. 3, the bridge circuit operates as follows. FET transistors Q3, Q4, Q5, Q6 operate as switches being either off or on. FET transistors Q3 and Q6 are both on or off together. FET transistors Q4 and Q5 also operate together but oppositely to Q3 and Q6. The two FET transistors Q3 and Q4 are driven from the logic circuit 70 output in lines 152 and 154 respectively. These outputs are out of phase, square wave voltages. Accordingly, only one of the transistors Q3 or Q4 is on at any given time. When transistor Q3 is on or the switch is closed, then diodes D3 and D5 conduct from the power source 31 through lines 110 and 112 and charge the capacitor C4 to more than 10 volts. The drain of the closed transistor Q3 is held low, and transistor Q5 has zero gate to source voltage and thus is an open circuit. When Q3 is turned off by the logic signal in line 152, the voltage on capacitor C4 then feeds through resistor R2 and drives the gate of FET transistor Q5 to more than 10 volts positive. This causes transistor Q5 to conduct and since there are no substantial current paths for the charge on capacitor C4 to be discharged, the voltage on the gate of transistor Q5 would stay positive for a longer period of time than the opening and closing time of the respective transistors Q3 and Q4. FET transistors Q4 and Q6 operate in the same manner as previously described relative to FET transistors Q3 and Q5. However, when transistor Q3 is closed, then transistor Q4 is open. It may thus be understood that when switch Q5 is closed, then current from the current control circuit 48 passes through line 61, line 119, through switch Q5, and through line 100 and winding 101 to the lamp 66. Coming out of the other end of lamp 66, the current is then fed through winding 103 and through line 102 and through diode D6, and then through line 126 through closed switch Q4, and through line 106 to line 63, the ground side of the input power source. Thus, the controlled constant current is directed through the lamp first in one direction and then in the opposite direction, with the switching being accomplished at very high speeds, maintaining the current through the lamp 66 at an absolute constant controlled level.

Figure 4:
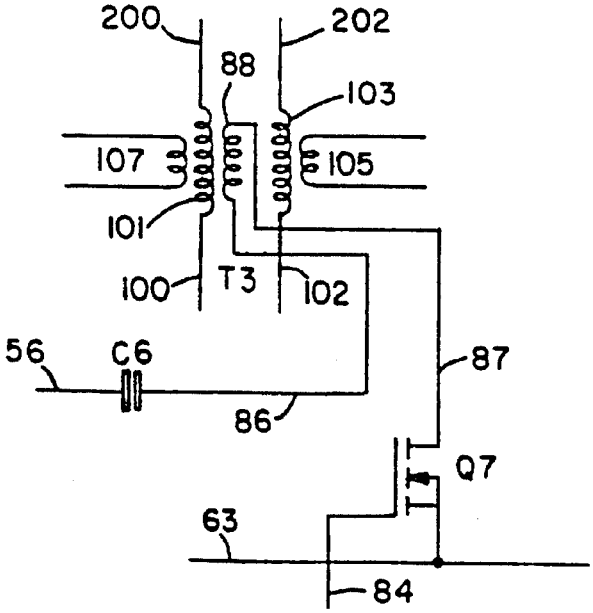
FIG. 4 is a schematic diagram of the ignitor circuit.

The ignitor circuit 68, see FIG. 4, is used to initially excite and ionize the gas in the fluorescent lamp 66, which requires a much higher voltage to start than to run. The ignitor circuit is controlled by the logic circuit 70 by turning FET transistor Q7 on. This causes the current pulses in line 53 of the current control circuit 48 to be directed through line 56 through the ignitor transformer T3 to lamp 66. These current pulses are at the rate of opening and closing of FET transistor Q2, which is about 30 KHz. The ignitor transformer T3 through its respective transformer windings feeds high voltage through lines 200 and 202 to the lamp 66. The ignitor transformer T3 also has windings 105 and 107 that connect to the filaments 92 of the lamp 66, that aid in starting the proper gas discharge across the tube. After a fixed time as determined by the logic circuit 70, the ignitor circuit 68 is disabled by turning off FET transistor Q7, and is not enabled again until or unless the voltage V3 on the input of the commutator circuit 62 exceeds a predetermined voltage level as determined by the logic circuit 70. This circuit functions such that the ignitor circuit 62 and the logic circuit 70 sense when there is not enough ionized gas in the lamp to cause a proper current in the lamp, or there is no lamp in place.

The ignitor circuit 68, see FIG. 4, receives the pulsing voltage through line 56 which is the drain of transistor Q2 in FIG. 1, which is coupled through capacitor C6 to the ignitor transformer T3. When FET transistor Q7 is non-conducting, as in response to being controlled by an input signal through line 84 from the logic circuit 70, then capacitor C6 has a level and the alternating-type voltage appears on the drain of transistor Q7. When transistor Q7 is conducting, then the alternating-type signal drives transformer T3. Its output applies a high voltage in lines 200 and 202, which is applied across the lamp 66. This voltage is in the order of about 1,000 volts. When the lamp 66 is conducting appropriately, this is sensed by the logic circuit 70 which then opens transistor Q7 through control line 84. There is no further current provided through the T3 primary winding. The current feed circuit of the commutator circuit is then coupled through the secondaries of transformer T3, windings 101 and 103, to the lamp 66, and the constant current is fed through the lamp 66 in the manner previously described. Using separate ignitor windings to ignite only, and a four transistor switch arrangement to commutate the polarity across the lamp. 66, allows 60 Hz operation.

Figure 5:
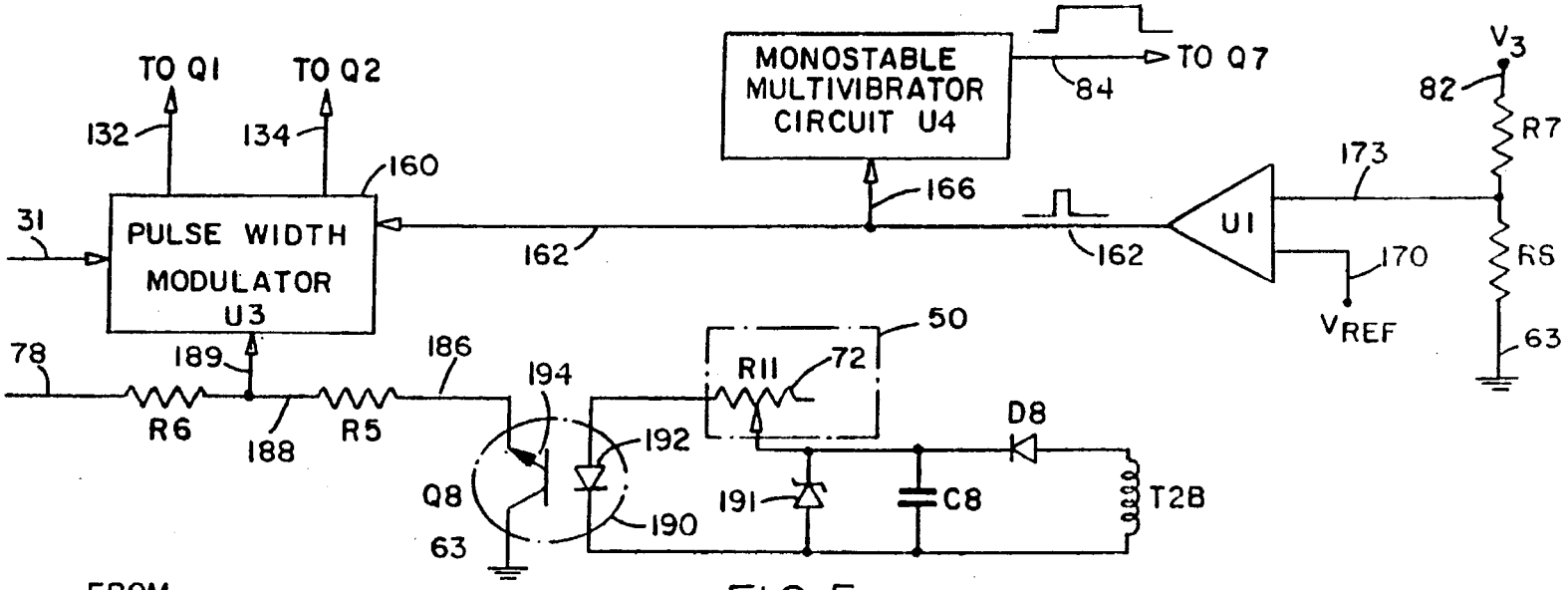
FIG. 5 is a schematic diagram, partially in block diagram, of the logic circuit.
Figure 7:
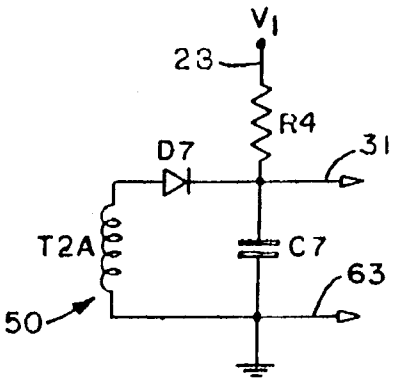
FIG. 7 is an illustrative schematic diagram of a power feed circuit to the logic circuit.

The logic circuit 70, see FIGS. 1 and 5, controls the pulse rate and the pulse widths to transistors Q1 and Q2, the start and stop of the ignitor circuit 68, and the switching rate to the commutating circuit 62. The power to the logic circuit 70 is initially supplied from the input power line 26 through line 28, see FIG. 7. Thus, power is supplied through resistor R4, and after the current control circuit starts operating, the winding T2A on transformer T2 provides the logic power. There is another winding on this same transformer T2, namely winding T2B, see FIG. 5, that supplies isolated power to the remote circuit 50 such that the remote circuit may be connected to the "building ground", and not be a shock hazard to the operator. The remote control, which sets the magnitude of the constant magnitude current, has a variable resistor R11 that drives an optical coupler 190 that comprises the light emitting diode 192 and the light sensitive transistor 194. In general, the output of the optical coupler 190 is compared with the voltage across the sense resistor R1 which is provided from point 94 through line 78 to resistor R6. This is compared with the current in line 188 and determines the pulse width signals that controls the set, level magnitude of the constant current to lamp 66, thus controlling the lamp's brightness.

The logic circuit operates as follows. The power from voltage V1 causes the current through resistor R4, through line 31, to energize the pulse width modulator U3. When the pulse drive voltage signal to transistor Q2 causes voltage to appear across the T2 transformer; the voltage from winding T2A is rectified by diode D7 and supplies the power to the logic circuit, see FIG. 7. The voltage generated in winding T2B is likewise rectified by diode D8, and is filtered by capacitor C8 and used to power the optical coupler 190, also designated as QS. A zener diode 191 provides a set reference voltage drop across the circuit that holds the standard voltage at the standard, set magnitude. This magnitude may be selectively varied through adjustment of the resistance 72 of the remote control device 50.

The current is then fed through transistor 194 and line 186 and through resistor R5 and is compared with that through resistor R6 from the sense resistor R1. This provides a known, set, fixed current to the lamp 66. If the current to lamp 66 should increase for some reason, then the added voltage across the sense resistor R1 will cause the current through resistor R6 to increase. This differential will be sensed in line 189 by the pulse width modulator control U3, and shorter pulse width signals will be fed through lines 132 and 134 to the respective transistors Q1 and Q2. This reduces the time that the respective transistors are closed, and the pulse width of current through T1 and T2 will be reduced and thus the current through lamp 66 will be reduced to the set level or magnitude.

A further portion of the logic circuit is the control for the ignitor circuit. The voltage V3 is applied to line 82, see FIG. 5, divided by resistors R7 and R8, which output is compared to a voltage reference 170 by a comparator circuit U1. When the voltage V3 in line 82 is too high, this will be detected by comparator U1 and an inhibit signal will be fed through line 162 to the pulse width modulator control U3. This inhibits U3 from providing any pulses to energize transistors Q1 and Q2. Accordingly, current will not be provided to line 58 from diode 52 until the voltage on V3 is decreased. This is usually a very short time period. When voltage V3 is appropriately reduced, then comparative circuit U1 ceases to provide an inhibit signal to U3, and pulses are again provided to transistors Q1 and Q2. The rise in voltage V3 causes the ignitor circuit to be energized. As a result the monostable multivibrator U4 is triggered by the same signal on line 162, which provides the inhibit signal to the pulse width modulator U3. The monostable multivibrator generates the time pulse through line 84 to turn on the ignitor transistor Q7, and the time ends after the pulse width modulator is operating and the lamp has ignited.

Figure 6:
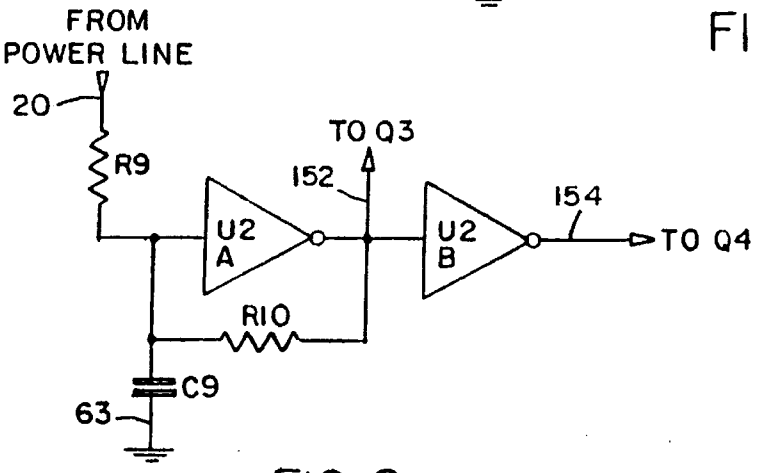
FIG. 6 is a schematic diagram for the oscillator drive circuit for providing switching current to the commutator circuit.

The control pulses that control the operation of transistors Q3 and Q4 of the commutator circuit 162, are provided by the invertor U2, having separate amplifying sections U2A and U2B, see FIG. 6. The invertor U2 is an invertor with hysteresis, and the first section U2A is used as an oscillator or waveform shaper. The invertor with hysteresis and resistor R10 and capacitor C9 make an oscillator with its output pulses being provided through line 152 to transistor Q3 and through U2B and line 154 to transistor Q4. This oscillator is synchronized with the signal inserted at the input line 20. This input is coupled through resistor R9, so that the frequency of the square wave from U2 will be locked to the 60 Hz frequency of the AC power line. The second section of U2B invertor U2, is used to provide an out-of-phase signal to the commutator circuit line 154.

In operation, the circuit of FIG. 1 is connected to a normal 60 Hz AC power source. This AC current is rectified by rectifier 22 and is fed as voltage V1 across capacitor C1. The power factor circuit 34 functions to store the current in winding T1 during the periods of time that transistor Q1 is closed, and to feed the current to the bulk capacitor C2 when transistor Q1 is opened. Accordingly, the amount of current passing to capacitor C2 is determined by the pulse width modulator signal, which is in turn controlled by the sense resistor R1, thus controlling the constant magnitude, current level provided to the lamp 66. Similarly, the voltage V2 is impressed across the current control circuit 48, where the operation of transistor Q2 causes winding T2 to store current during the period that transistor Q2 is closed, and to deliver current in a fly-back mode when transistor Q2 is open. Again, the time transistor Q2 is closed is determined by the pulse width modulator U3 in the logic circuit 70. This determines the constant current magnitude that is fed to capacitor C3 and to the commutator circuit and to lamp 66.

So to initiate the system, power introduced at power source 20 causes a rise in the voltage V1 which is provided through line 28 to the logic circuit 70. The logic circuit energizes and pulse width modulator U3 starts switching FET transistors Q1 and Q2. This causes voltages V2 and V3 to increase. Since the lamp 66 is not yet ionized, there is no load on voltage V3. So the voltage V3 rises until it reaches a magnitude, for example, about 400 volts. This voltage level is sensed by the comparator U1 of FIG. 5, through the resistance divider circuit of resistances R7 and R8. The output of comparator U1 then goes high, providing an inhibit signal to the pulse width modulator U3. This ceases further pulses to transistors Q1 and Q2 and there is thus a decrease in the voltage V3. When voltage V3 decreases, the output of comparator V1 goes low enabling the pulse width modulator. The output of comparator U1 is fed through line 162 to the U4 monostable multivibrator, which provides an output signal through line 84 to FET transistor Q7 that initiates the ignitor circuit 68. The signal on line 84 turns on transistor Q7, and when transistor Q7 closes, the primary winding T3 is energized by the pulses from the transformer T2. These pulses go through the primary winding 88 of T3 and raises the voltage across winding 101 and 103 to the 1,000 volts necessary to ionize the lamp 60 and initiate its operation. The multivibrator U4 holds transistor Q7 on for the period of time required to accomplish this. The low impedance of the lamp 66, when fully ignited, loads winding T3 lowering its high output voltage. When the multivibrator U4 shuts off the signal to line 84, then winding T3 becomes passive and the gas has already been ionized in the lamp. With this, the normal operation of the lamp proceeds.

In this normal operation, the remote control resistor R11 is set for full current to the lamp. For this current, the pulse width modulator 160 will require a given voltage across R1 to cause a null at line 189. This given voltage drop represents the current from capacitor C2 into the lamp circuit that achieves full brightness. If dimming is desired, then the remote control resistor R11 is adjusted for a lower voltage in line 186. This requires a corresponding lower voltage drop across resistor R1, and this represents a lower current through resistor R1 and less current delivered to the lamp 66. Thus if any parameter change occurs from the desired remote control setting, then the pulse width modulator will change the pulse width pulses to lines 132 and 134. The new pulse width pulse to line 132 and line 134 causes more or less current through sense resistor R1 as needed to balance the input to the pulse width modulator 160.

The fly-back circuit in the current control circuit 48 is a constant current device. The voltage V3 is identical to the voltage across the lamp 66. Essentially all of the current through the lamp goes through R1, which generates the feedback voltage on line 78. The amount of current in the lamp is independent of V3 since it is controlled by the voltage drop across R1.

Thus the system of this invention sets the current to the lamp 66 at a constant magnitude, and maintains this set, constant magnitude at a level controlled by the setting of R11.

Figure 8:
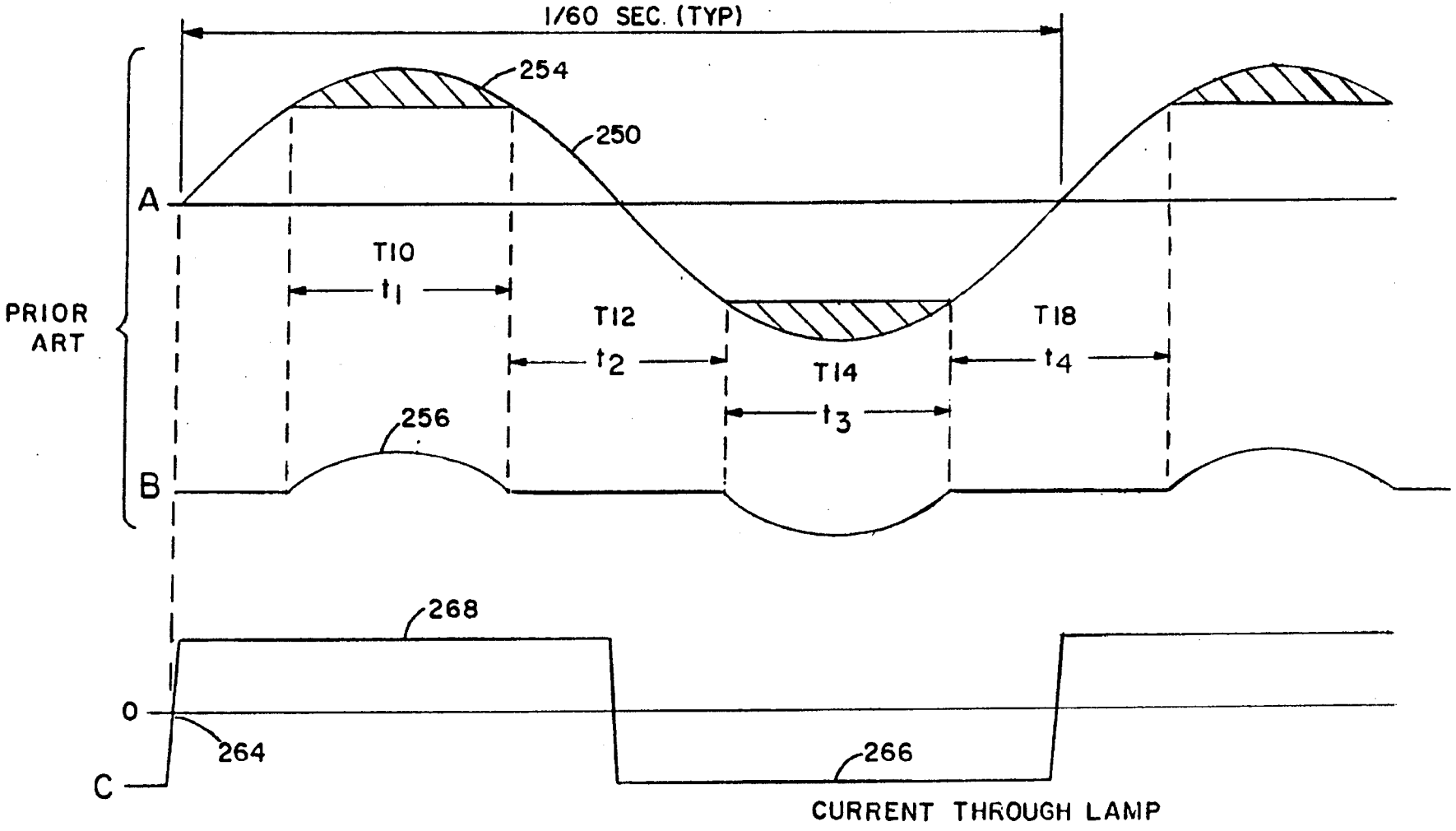
FIG. 8 is a diagram of voltage and current waveforms in prior art systems, and the current waveform in this invention.

Referring to FIG. 8, in conventional coil and core ballast systems, the voltage waveforms, as for example sine wave 250, are illustrated. The ballast generally holds the voltage to about 120 volts, which is the ionization voltage of the lamp. However the current only flows in the lamp when the input voltage is 120 volts or higher. Generally the voltage is held by the inductance of the ballasts plus the lamp in the shady area 254 to 120 volts or higher. So when the voltage applied to the lamp is above the gas ionization voltage during the shaded part 254 of the waveform 250, at times T10 and T14, the lamp ionizes. During times T12 and T18, at which times the voltage is below 120 volts, the lamp starts to de-ionize. So during this cycle, the current through the lamp at times T10 and T14 is limited, but not controlled, and has a peak value much higher than the average value as illustrated at 256. This peak current 256 damages the lamp and lowers the efficiency even though good designs try to minimize peak to average value. The times T12 and T18 have no current through the lamp, because the voltage 250 is below the ionization potential of the lamp.

In this invention, the voltage is relatively constant at 120 volts or as determined by the gas in the lamp. The illumination of the lamp is totally current controlled. The current is applied first in one polarity as shown by the solid lines 268 and is reversed as shown by the dotted lines 266. All voltages are positive With respect to the circuit common or ground 260, but the polarity at each end of the lamp reverses with respect to the other end, at the rate of the AC line voltage of the power source. The current is switched with very fast rise and fall times as illustrated by the rise current 264, allowing minimum time for deionization. The current is controlled because there is never a peak, thus a desired amount of constant magnitude current is applied to the lamp in a continuous manner, reversing polarity at the AC line rate. This results in increased lamp life and efficiency. The current and voltage waveforms are the same because there is no time allowed for deionization.

Having disclosed our invention we now claim:

1. In a combination for exciting a fluorescent lamp to obtain luminescence from the lamp;

a current source for providing a direct current and voltage;

a commutator that impresses said direct current across the fluorescent lamp;

a current control circuit for maintaining said direct current to the lamp at a constant set level of magnitude that is independent of voltage changes across the lamp, said commutator circuit including a switching circuit for switching the polarity of said constant direct current at a high speed having sharp rise and fall times, maintaining the switched direct current at a non-pulsing, constant level of magnitude across the fluorescent tube, said current control circuit having means for setting said direct current at a magnitude that is held constant, irrespective of changes in voltage across the fluorescent lamp, said current means including means responsive to a normal 60 Hz AC voltage source for providing output current;

current storage means for supplying current to said control circuit and maintaining a stored current at a magnitude sufficient to provide said direct current at a constant level of magnitude, during the low voltage cycle of said AC voltage source, said switching means having means responsive to the AC line voltage for switching said constant direct current at the same periodic rate of the AC line voltage, a power factor control circuit for processing said direct current provided by said direct current means to a set power factor, said current storage means having means for storing the output direct current from said current control circuit causing a voltage increase or decrease, a sensing circuit having a standard voltage for sensing the magnitude of the constant magnitude current supplied to said fluorescent lamp, comparing said current with said standard, and providing an output control signal, means in said current control circuit for changing the magnitude of said current in response to said control signal, means for changing the set magnitude of said current, and pulse width modulator means responsive to said sensor control signal for providing pulses of current to said current control circuit for controlling the constant magnitude of said current to the set constant level.

2. A circuit for energizing a fluorescent lamp to obtain luminescence from the lamp, comprising:

a power supply responsive to an AC power input for providing a DC power output;

a power factor circuit responsive to said DC power output for providing a resistive impedance to said power supply, said power factor circuit including an inductor, a power factor switch, and a power factor diode, wherein said inductor stores energy when said power factor switch is closed and wherein said power factor diode conducts current from the inductor when said switch is open;

a controlled current source responsive to said power factor circuit for providing a direct current having a constant magnitude that is selected, said controlled current source including a storage capacitor, a current source switch, a transformer winding, a current source diode, and a capacitor, wherein said storage capacitor is charged by the current output of the power factor circuit diode, said transformer winding stores energy when said current source switch is closed, said current source diode conducts current from the transformer winding when said current source switch is open, and said capacitor is charged by the current output of said current source diode, wherein said current source diode and said capacitor provide the current output of the controlled current source;

commutating means responsive to said constant magnitude direct current for providing a polarity reversing square-wave current of substantially constant magnitude to the fluorescent lamp, said square-wave current reversing polarity at the frequency of the AC power input to said power supply;

igniter means separate from said commutating means for controllably applying a starting voltage to the fluorescent lamp;

control means responsive to the current provided to the fluorescent lamp by said commutating means for pulse width modulating said power factor circuit switch and said controlled current source switch such that said power factor circuit presents a resistor-like impedance and the selected constant magnitude of said direct current output of said controlled current source is substantially independent of voltage changes across the fluorescent lamp, said control means further selecting the constant magnitude of the direct current provided by said controlled current source and controlling said igniter means such that said starting voltage is applied only to start the lamp and is removed after the lamp is conducting properly.

3. The circuit of claim 2 wherein said control means includes:

means for sensing the voltage across the fluorescent lamp; and igniter control means for enabling said igniter means to provide said starting voltage when said lamp voltage indicates that said AC power is present and the lamp has not been started.

4. The circuit of claim 3 wherein said igniter control means enables said igniter means to provide said starting voltage for a predetermined amount of time.

5. The circuit of claim 2 wherein said AC power input has a frequency of 60 Hz.

* * * * *